US005257606A

United States Patent [19]

Willman et al.

[11] Patent Number: 5,257,606

[45] Date of Patent: Nov. 2, 1993

[54] FUEL PUMP ACCUMULATOR

[75] Inventors: Gary G. Willman, Belleville, Ill.; Richard J. Dunn, Bourbon, Mo.

[73] Assignee: Carter Automotive Company, Inc., Southfield, Mich.

[21] Appl. No.: 902,106

[22] Filed: Jun. 23, 1992

[51] Int. Cl.[5] ..... F02M 7/00

[52] U.S. Cl. ..... 123/447; 123/467; 417/540

[58] Field of Search ..... 123/447, 467, 506, 446; 417/540, 541

[56] References Cited

U.S. PATENT DOCUMENTS

| | | | |
|---|---|---|---|
| 2,090,781 | 8/1937 | Camner | 123/467 |
| 3,592,568 | 7/1971 | Fenne | 123/467 |
| 4,029,071 | 6/1977 | Saito | 123/447 |
| 4,077,376 | 3/1978 | Thoma | 123/467 |
| 4,091,771 | 5/1978 | Rapp | 123/447 |
| 4,167,168 | 9/1979 | Yamamoto | 123/467 |
| 4,612,893 | 9/1986 | Ishibashi | 123/447 |
| 4,633,836 | 1/1987 | Faupel | 123/467 |
| 4,696,271 | 9/1987 | LeBlanc | 123/447 |

FOREIGN PATENT DOCUMENTS

| | | | |
|---|---|---|---|
| 81262 | 8/1934 | Sweden | 123/467 |

*Primary Examiner*—Carl S. Miller
*Attorney, Agent, or Firm*—Lawrence J. Shurupoff

[57] ABSTRACT

An accumulator includes a tubular housing mounted directly on a pump housing so that the accumulator chamber is located in near proximity to the pump chamber. The accumulator chamber may be defined partly by a check valve that isolates the pump from pressure surges while they are being damped by the accumulator. In a preferred arrangement, the accumulator housing has a threaded connection to the pump housing.

10 Claims, 1 Drawing Sheet

FIG 1
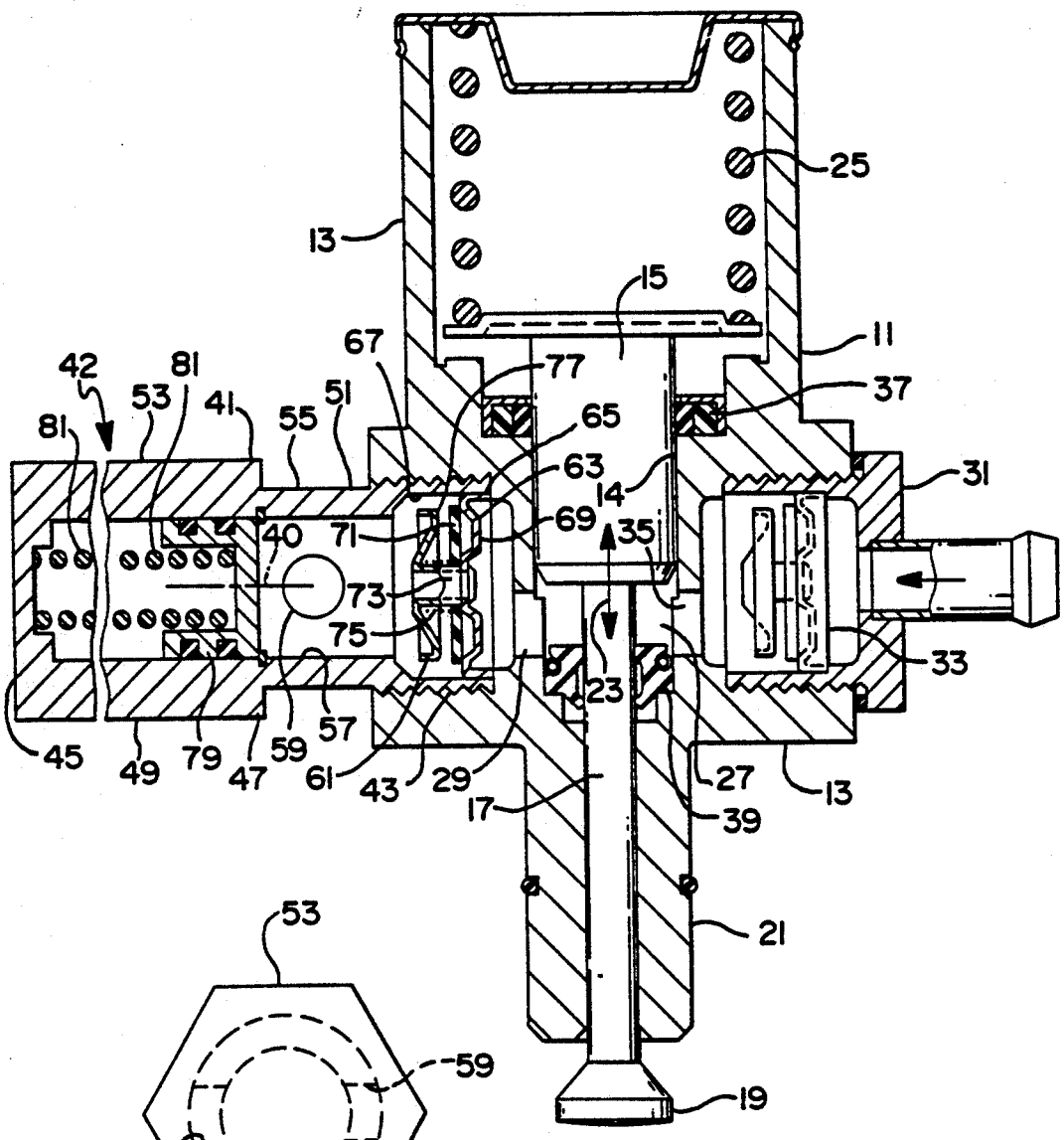
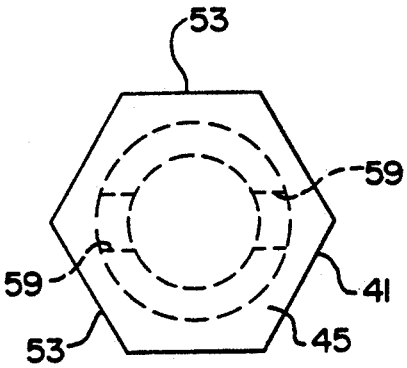
FIG 2

FUEL PUMP ACCUMULATOR

BACKGROUND OF THE INVENTION

1. Field of the Invention

This invention relates to a liquid accumulator for minimizing pressure surges associated with the operation of a reciprocating pump. The accumulator is especially useful in engine fuel supply systems that employ reciprocating fuel pumps for developing fuel supply pressure.

2. Description of Prior Developments

Accumulators have been used in engine fuel supply systems to minimize or dampen fuel pressure surges associated with the operation of pistonoperated fuel pumps. The following U.S. Patents show engine fuel supply systems having accumulators for minimizing pressure surges:

U.S. Pat. No. 3,412,718 to Long granted Nov. 26, 1968

U.S. Pat. No. 4,161,161 to Bastenhos granted Jul. 17, 1979

U.S. Pat. No. 4,440,134 to Nakao et al. granted Apr. 3, 1984

U.S. Pat. No. 4,462,368 to Funada granted Jul. 31, 1984

U.S. Pat. No. 4,615,320 to Fehrenback granted Oct. 7, 1986.

In some cases, even with the presence of an accumulator in the fuel system, premature failure of the pump seals can occur due to seal damage caused by pressure spikes. The presence of such pressure spikes or surges may be due to the fact that the accumulator is often located a considerable distance downstream from the pump. The seal failure problem is aggravated when there is no check valve between the pump and the accumulator.

When the accumulator is located remote from the pump, a relatively large mass of high energy liquid accumulates between the accumulator and the pump outlet port. As the accumulator accepts the surging liquid at the beginning of each pump output stroke, a back-flowing pressure surge is generated and propagated back toward the pump due to the inertia of the large liquid mass located between the accumulator and pump. The resulting pressure surge developed in overcoming this inertia exerts a peak force on the pump seals which may lead to premature seal and pump failure.

SUMMARY OF THE INVENTION

The present invention relates to an accumulator and check valve for absorbing hydraulic surge energy generated by the reciprocating action of a high pressure fuel pump. The instantaneous pressure spikes associated with previous pump output strokes are to a large extent removed, or at least greatly reduced in amplitude, so that the fuel can be more accurately controlled and more precisely metered to the engine. Moreover, damage to pump seals can be reduced or eliminated.

The accumulator preferably includes a tubular housing having an inlet portion screwed directly into the outlet port of the fuel pump so that the accumulator chamber is relatively close to the reciprocating pump element. A check valve is mounted in the upstream end of the accumulator housing quite close to the pump element. Pressurized liquid fuel flows from the pump through the check valve and then against a spring-biased piston spaced a short distance from the check valve, e.g., about three-fourths of an inch in the case of a typical automotive engine fuel supply system. The accumulator piston is thus moved directly away from the check valve to increase the volumetric displacement of the accumulator chamber. Compression of the spring by the accumulator piston absorbs at least some of the surge energy in the flowing liquid.

A principal feature of the invention is the fact that the check valve is located in near proximity to the fuel pump piston so as to eliminate the presence of a long column of fuel between the accumulator and the pump piston. Also, the check valve forms one wall of the accumulator such that surging liquid is confined to a relatively small zone between the check valve and the accumulator piston.

These features enable the pressure surges to be effectively dampened without allowing the surge energy to be propagated back into the pump so as to prematurely overload and destruct the pump seals. The invention seeks to have the accumulator chamber relatively close to the pump outlet so that only a relatively small mass of surging liquid has to be accommodated in the accumulator chamber. The invention avoids the situation where a long column of high energy liquid can accumulate between the pump and the accumulator and thereby present a significant source of resistance to the fuel pump.

A particular advantage of the invention is the provision of a simple threaded connection between the accumulator and pump housing. This connection not only facilitates assembly, it also simplifies replacement and repair of the accumulator.

BRIEF DESCRIPTION OF THE DRAWINGS

FIG. 1 is a sectional view taken through a liquid pump having an accumulator of the present invention incorporated therein.

FIG. 2 is a left end view of the accumulator shown in FIG. 1 .

DETAILED DESCRIPTION OF THE PREFERRED EMBODIMENTS

FIG. 1 shows an essentially conventional fuel pump 11 of the type used in an engine fuel supply system. The fuel pump is typically located between a fuel tank and a fuel injection system. The pump pressurizes the liquid fuel to a sufficient pressure for operating the injectors in timed sequence with the engine.

Fuel pump 11 includes a pump housing 13 that defines a cylindrical guide surface 14 for a pump piston 15. A rod 17 extends axially from the piston to form an enlarged head 19. Pump housing 13 includes a reduced diameter tubular section 21 that is adapted to extend through a socket on the engine so that head 19 registers with a cam operator driven by the engine or by an electric motor. Rotation of the cam operator causes the piston 15 and rod 17 to reciprocate back and forth along axis 23. A compression spring 25 is operatively positioned in housing 13 to keep the piston 15 and rod 17 unit in continuous operative connection with the cam operator. Spring pressure moves the piston on its power stroke, whereby liquid fuel in pump chamber 27 is pressurized for movement in a right-to-left direction through pump exit port 29.

Liquid fuel is supplied to the pump through an inlet fitting 31 that screws into a threaded opening in the pump housing. The fitting has a check valve 33 therein that permits liquid to be drawn into pump chamber 27 through an inlet port 35. The check valve prevents reverse liquid flow out of the pump chamber. When piston 15 is moved downwardly along guide surface 14, liquid fuel in chamber 27 is pressurized and pumped out of the chamber through exit port 29. Upward motion of the piston draws new liquid through check valve 33 into the pumping chamber.

The illustrated pump has an upper annular seal 37 preventing upward liquid flow along the side surface of piston 15, and a lower annular seal 39 preventing downward liquid flow along the surface of rod 17. These seals also prevent air flow into the pump chamber.

An accumulator 42 is connected directly to the pump housing in direct proximate communication with pump exit port 29. The illustrated accumulator includes a hollow tubular housing 41 having an open threaded end 43 and a closed end 45. The housing includes an annular side wall 47 that has a thickened section 49 and a somewhat thinner wall section 51. Thickened side wall section 49 has external wrench flats 53 (FIG. 2) formed thereon, so that the housing can be screwed into a threaded hole in pump housing 13 to the position shown in FIG. 1, i.e. on an axis 40 extending normal to pump piston axis 23.

The relatively thin side wall section 51 of housing 41 has a circular outer surface 55 and a circular inner surface 57. At least one liquid discharge port 59 is formed in side wall section 51 for directing pressurized liquid from the accumulator to the fuel injection system. A fitting may be provided at each port 59 for connecting one end of a rigid pressure-resistant tube to the accumulator housing.

Mounted within the threaded section of the accumulator housing is a check valve 61. Check valve 61 includes a stationary wall 63 having a peripheral flange 65 forming a press-fit mounting on internal side surface 67 of the accumulator housing. Flow ports 69 extend through wall 63 to conduct pressurized liquid against the right face of a resilient deflectable disk 71. The disk has its central portion affixed to the central portion of wall 63 by central post 73 and compression coil spring 75. An outwardly radiating wall 77 on post 73 acts as an annular stop to limit the deflection of resilient disk 71.

Liquid pressure on disk 71 causes the peripheral edge area of the disk to deflect away from wall 63, whereby the liquid can flow in a right-to-left direction through the check valve and against an accumulator piston 79 that is slidably guided on the cylindrical surface formed within the accumulator housing. Piston 79 is in direct axial alignment with check valve 61 such that the pressurized liquid flows in a generally straight linear path in order to reach the piston.

A compression coil spring 81 is mounted between the closed end 45 of the accumulator housing and piston 79 for resiliently resisting movement of the piston in a right-to-left direction. Pressure surges in the flowing liquid are absorbed by spring 81 and also by air compression in the closed space between the piston and housing end wall 45.

The accumulator chamber is defined as the axial space between check valve disk 71 and piston 79. As shown in FIG. 1, the accumulator chamber is in its minimum volume position. The length of piston guide surface 57 is such that the piston can move leftwardly a sufficient distance to appreciably expand the volume of the accumulator chamber without allowing the flowing liquid to escape from the expanded volume along the stroke length of the piston. The maximum volume of the accumulator chamber is preferably at least one and one-half the illustrated contracted volume.

In one embodiment, housing 41 can have an external total length of about 1.8 inch and an external diameter across threaded section 43 of about 0.7 inch. The stroke of piston 79 can be about 0.7 inch. The expanded volume of the accumulator chamber is about twice its contracted volume.

Check valve 61 is located in relatively close proximity to pump exit port 29 and pump element 15. There is a relatively small liquid accommodation space between the check valve and pump chamber 27. When the surge pressure generated by pump piston 79 forces piston 79 leftwardly to expand the accumulator chamber, the pressurized liquid will tend to rebound from piston 79 back through check valve 61 so as to exert a potentially high force on seal 39 or seal 37. However, at the same time, the rebounding liquid will tend to close disk 71 against wall 63, thereby limiting the destructive effect of the liquid on the pump components. There is a relatively small quantity of liquid to the right of check valve 61 with a correspondingly small energy available for destructive purposes.

The primary purpose of the accumulator is to minimize and dampen undesired pressure pulsations in the downstream lines leading from discharge port(s) 59. This is accomplished by the motion of accumulator piston 79. Although the piston motion is not new per se, it is believed new to locate the accumulator in a position screwed directly into the pump housing at right angles to the movement axis 23 of the pump piston. The accumulator mounting location on the pump housing achieves a minimum spacing of the accumulator check valve from the pump chamber, with a corresponding reduction in hydraulic energy that can be propagated back toward the pump seals. The invention avoids the situation where a large column of high energy liquid can rebound and move in a reverse direction from an accumulator check valve back into the pump.

As previously noted, the accumulator chamber is defined by the axially-aligned check valve and piston 79. The entire end face of the piston is exposed to the surge pressure such that the piston has a relatively fast response to surge conditions. Also, the accumulator design lends itself to manufacture at a reasonably low cost.

The drawing necessarily depicts a specific structure embodying the invention. However, it will be appreciated that the invention can be practiced in various forms.

what is claimed is:

1. An engine fuel supply system comprising:

a fuel pump having a reciprocating pump element mounted within a pump housing;

an accumulator connected directly to the pump housing for absorbing pressure surges generated by movement of the pump element, said accumulator comprising an expansible chamber having an expanded maximum volume and a contracted minimum volume;

a check valve located within the pump housing between the accumulator and the pump element, said check valve being in close proximity to the pump element to isolate the pump element from backflowing pressure surges, said check valve forming one wall of said expansible chamber; and a piston movable along a stroke length within said expansible chamber so as to define said minimum volume and said maximum volume, said piston preventing flow from said expansible chamber along said stroke length.

2. The improvement of claim 1, wherein said accumulator comprises a hollow tubular housing having a threaded end section screwed into the pump housing.

3. The improvement of claim 2, wherein said check valve is located within the threaded end section of the accumulator housing.

4. The improvement of claim 8, wherein said accumulator comprises a piston movable within said housing toward or away from the check valve, and the space between the piston and check valve defining an expansible chamber means.

5. The improvement of claim 4, wherein said accumulator housing has a closed end remote from said threaded end section, and a compression coil spring seated between said housing closed end and said piston for resiliently resisting movement of the piston away from the check valve.

6. The improvement of claim 5, wherein said accumulator housing has an annular side wall and a fuel discharge port formed in said side wall and communicating with said expansible chamber, said discharge port being located between the piston and the check valve.

7. The improvement of claim 6, wherein the side wall of the accumulator housing has external wrench flats formed thereon whereby said housing can be screwed into the fuel pump.

8. An engine fuel supply system, comprising:

a pump housing;

a fuel pump having a reciprocating pump element mounted within said pump housing;

an accumulator connected directly to said pump housing for absorbing pressure surges generated by movement of said pump element, said accumulator comprising a hollow tubular housing having a threaded end section screwed into said pump housing; and a check valve located within said threaded end section of said housing.

9. An engine fuel supply system, comprising:

a pump housing;

a fuel pump having a reciprocating pump element mounted within said pump housing;

an accumulator connected directly to said pump housing for absorbing pressure surges generated by movement of said pump element, said accumulator comprising an accumulator housing having one closed end and an expansible chamber located within said accumulator housing;

a check valve located within said pump housing between said accumulator and said pump element;

a piston movable within said expansible chamber over a predetermined stroke length; and means for absorbing pressure surges provided between said closed end of said accumulator housing and said piston.

10. The system of claim 9, wherein said means for absorbing pressure surges comprises means for compressing air.

* * * * *